US006087606A

United States Patent [19]

Simpson

[11] Patent Number: 6,087,606

[45] Date of Patent: Jul. 11, 2000

[54] WATERPROOF SWITCH WITH SINGLE CONTACT AND METHOD FOR MANUFACTURING SAME

[75] Inventor: Leonard Simpson, Margate, Fla.

[73] Assignee: Micro Contacts Inc., Hicksville, N.Y.

[21] Appl. No.: 09/323,843

[22] Filed: Jun. 2, 1999

[51] Int. Cl.[7] ..... H01H 1/26

[52] U.S. Cl. ..... 200/535; 200/551

[58] Field of Search ..... 200/239, 245, 200/246, 283, 284, 302.1, 551

[56] References Cited

U.S. PATENT DOCUMENTS 4,803,313 2/1989 Rolf ..... 200/6 BB 5,357,230 10/1994 Mikawa ..... 335/78

*Primary Examiner*—Lincoln Donovan
*Assistant Examiner*—Nhung Nguyen
*Attorney, Agent, or Firm*—Jay H. Maioli

[57] ABSTRACT

A waterproof switch has a single contact arranged in a sealed housing, with an actuator arm protruding from one end and electrical terminals protruding from an opposite end. The single contact is arranged close to a metal portion that is moved by the actuator into mechanical and electrical contact with the single contact. The sealed housing is formed of two pieces that are attached by a heat activated adhesive. The switch can be assembled by forming the metal switch parts on a long strip and subsequently, following the assembly of the housing, the small metal portions joining the switch parts are sheared away.

4 Claims, 4 Drawing Sheets

10
12
14
16
18
20
22
24
26
28
30
4
40

WATERPROOF SWITCH WITH SINGLE CONTACT AND METHOD FOR MANUFACTURING SAME

BACKGROUND OF THE INVENTION

1. Field of the Invention

This invention relates generally to a waterproof switch and, more particularly, to a waterproof switch that has a single contact surrounded by a waterproof case and which has a construction intended for ease of manufacturing.

2. Description of Background

There is always a demand for a waterproof switch, however, such switches tend to be somewhat complex both in their mechanical construction, as well as in the manufacturing process required to assembly such switches.

Some waterproof switches provide for a flexible case or covering over the switch elements and the switch actuation occurs by deformation of the flexible casing. In addition, some waterproof switches have multiple contacts arranged inside the waterproof casing, which necessitates a complicated assembly operation.

There exists a need for a waterproof switch with only a single contact and which can be manufactured relatively easily and at low cost.

OBJECTS AND SUMMARY OF THE INVENTION

Accordingly, it is an object of the present invention to provide a waterproof switch having only a single contact and which can be manufactured easily and relatively inexpensively.

In accordance with an aspect of the present invention, the single contact and its actuator are arranged in overlying relationship and top and bottom plastic sheets are arranged to encapsulate the contact, with the two sheets being adhered to each other with a heat curing adhesive. The actuator arm for the switch extends out of the flexible casing at one side and the electrical terminals for connection to the contact and the actuator extend out of another side of the case.

According to another aspect of the present invention, the switch can be manufactured by forming the contact elements in metal strip form and then operating on the metal strip to place the contacts in the proper spatial relationship before arranging the top and bottom portions of the casing therearound. Subsequently, a shearing operation is performed that separates the electrical terminations for the switch.

The above and other objects, features, and advantages of the present invention will become apparent from the following detailed description of illustrative embodiments thereof to be read in conjunction with the accompanying drawings.

DETAILED DESCRIPTION OF PREFERRED EMBODIMENTS

Figure 1:
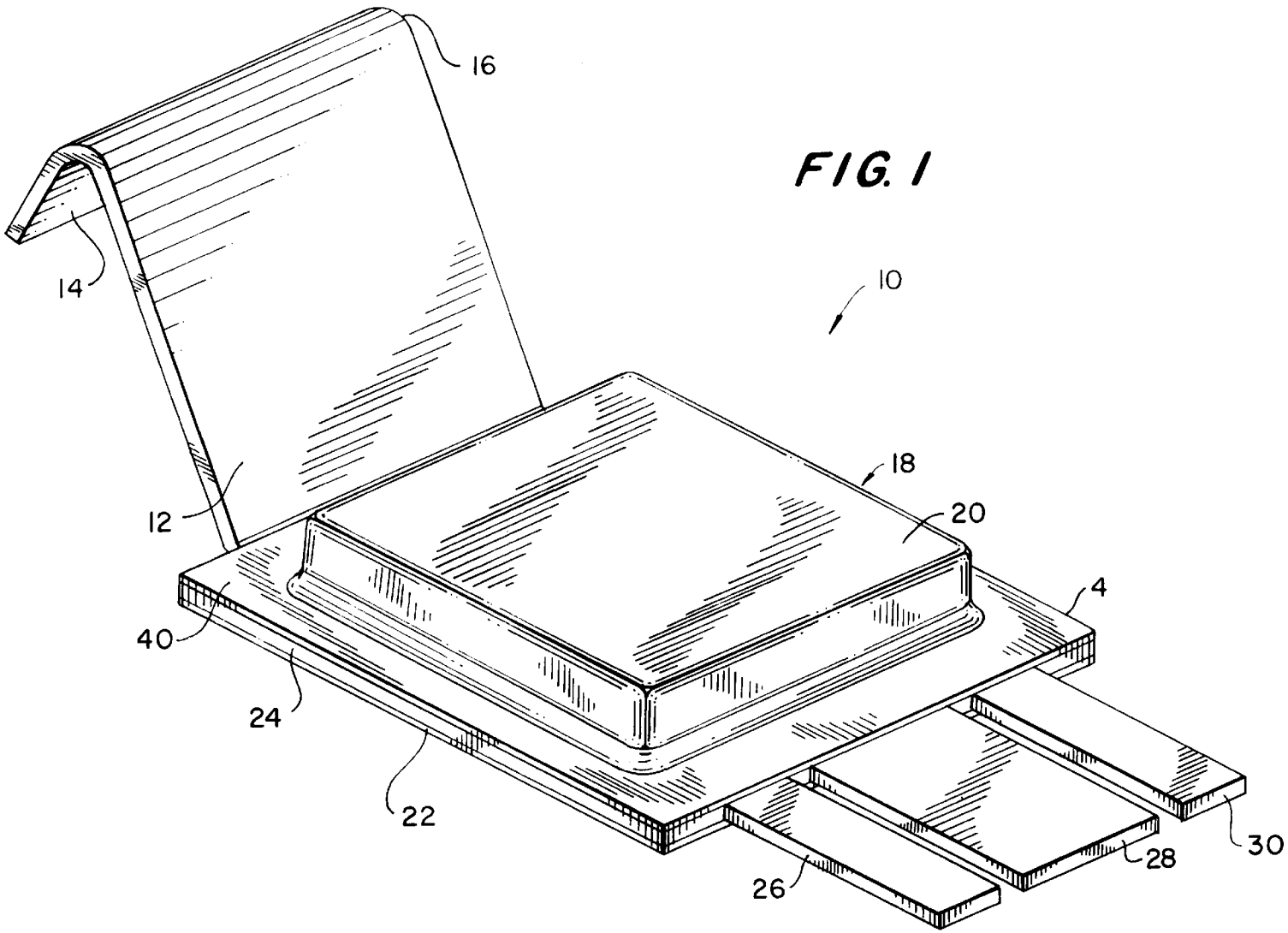
FIG. 1 is a perspective view of a waterproof switch according to an embodiment of the present invention.

In FIG. 1 a waterproof switch 10 is shown with an actuator element 12 that is a metal element formed of hardened brass, for example, having spring properties and with a free end 14 formed with a curved or arcuate section shown generally at 16 protrudes from a side edge 17. The switch 10 has a composite body 18 formed of an upper element 20 and a lower plate-like element 22 that are adhered one to another by means of a heat curable adhesive layer 24. The electrical contacts forming the switch are arranged inside the switch body 18 and, specifically, in an upraised hollow portion of the upper element 20. The two electrical connections for the single contact switch are shown at 26 and 28 protruding from a side edge 25. Another electrical connection is provided at 30, which is, in fact, electrically the same as connection 26. This switch 10 can be a miniature switch having a switch body 18 approximately 0.300 inches on a side and having a thickness of approximately 0.1875 inches.

Figure 2:
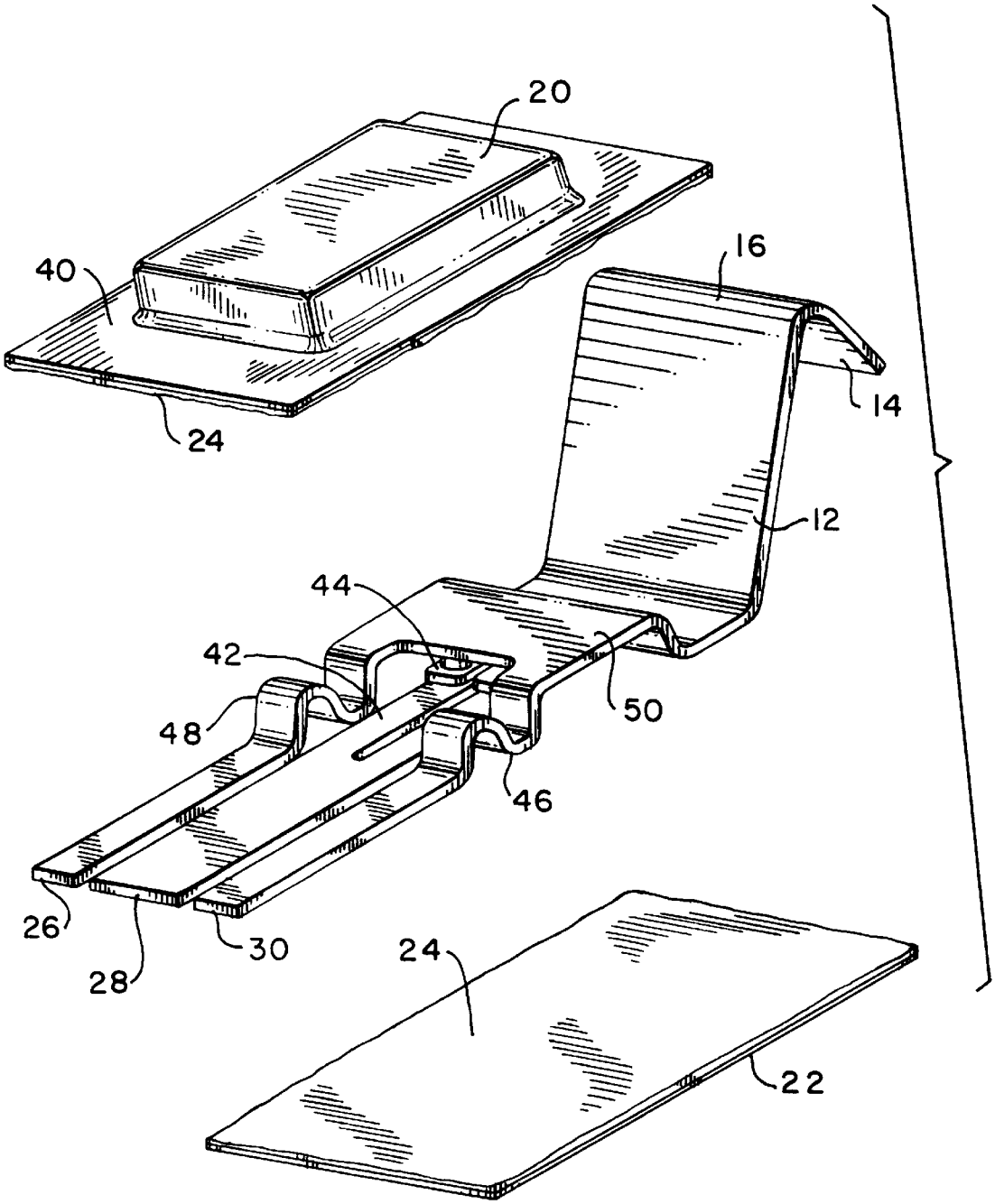
FIG. 2 is an exploded view of the switch of FIG. 1.

Referring now to FIG. 2, the switch of FIG. 1 is shown in disassembled or preassembled condition in which the upper box-like element 20 of the composite body 18 is shown separate and apart from the lower planar sheet of plastic material 22. As shown in FIG. 2, the heat curing adhesive layer 24 starts out as a coating on both a lower surface of a flange portion 40 of the upper casing 20 and on an upper flat surface of the bottom plate element 22. Nevertheless, only one such surface need be coated with the adhesive.

The construction of the electrical contacts is shown in FIG. 2, and it is seen that a first metal contact element 27 has the electrical connection and 28 bifurcated into two arms 42, each of which has a metal contact point 44 arranged at the free end thereof. Alternatively, only a single metal contact point could be used as the contact end 44. Electrical connections 26 and 30 are a part of the moving contact portion forming a second metal contact element 29 that is integrally formed with the actuator 12 and that contact portion is formed having two crimped portions 46 and 48 and a large contact surface forming a middle portion 50 that continues on into the actuator portion 12.

To assemble the switch the metal parts are arranged on the bottom plate element 22 and the upper casing is placed over the metal parts, so that the two adhesive surfaces 24 are in contact. Heat is then applied and the body 18 is hermetically sealed.

Upon utilization of the switch following assembly, the electrical connections are made to terminal 28 and one or both of terminals 26 and 30 and the switch is placed in position for a mechanical operation of actuator 12 that protrudes from a side edge 23 of the body 18. Upon applying some force to the arcuate area 16 of the actuator 12 to cause the actuator 12 to deflect downwardly, when in a position as shown in FIG. 1, the crimped portions 46 and 48 provide some spring-like action and the flat contact portion 50 is moved into mechanical and electrical contact with the contact portions 44, thereby "making" the switch. The metal portions of the switch described above may be made of hardened brass, stainless steel, or beryllium copper, and a typical contact spacing might be from approximately 0.005 to 0.035 inches.

In the construction of the waterproof case 18 formed of, the lower flat element 22 is a planar sheet of plastic material and the upper element 20 that has the hollow portion with an open side 21 and flange 40, the lower piece 22 can be made of a more rigid plastic than the upper element 20, which thereby permits the upper element 20 and the heat activated adhesive 24 to form around the contacts and create a sealed condition. On the other hand, both elements can have the same flexibility. Urethane is seen to be an appropriate material for these plastic parts.

Figure 3:
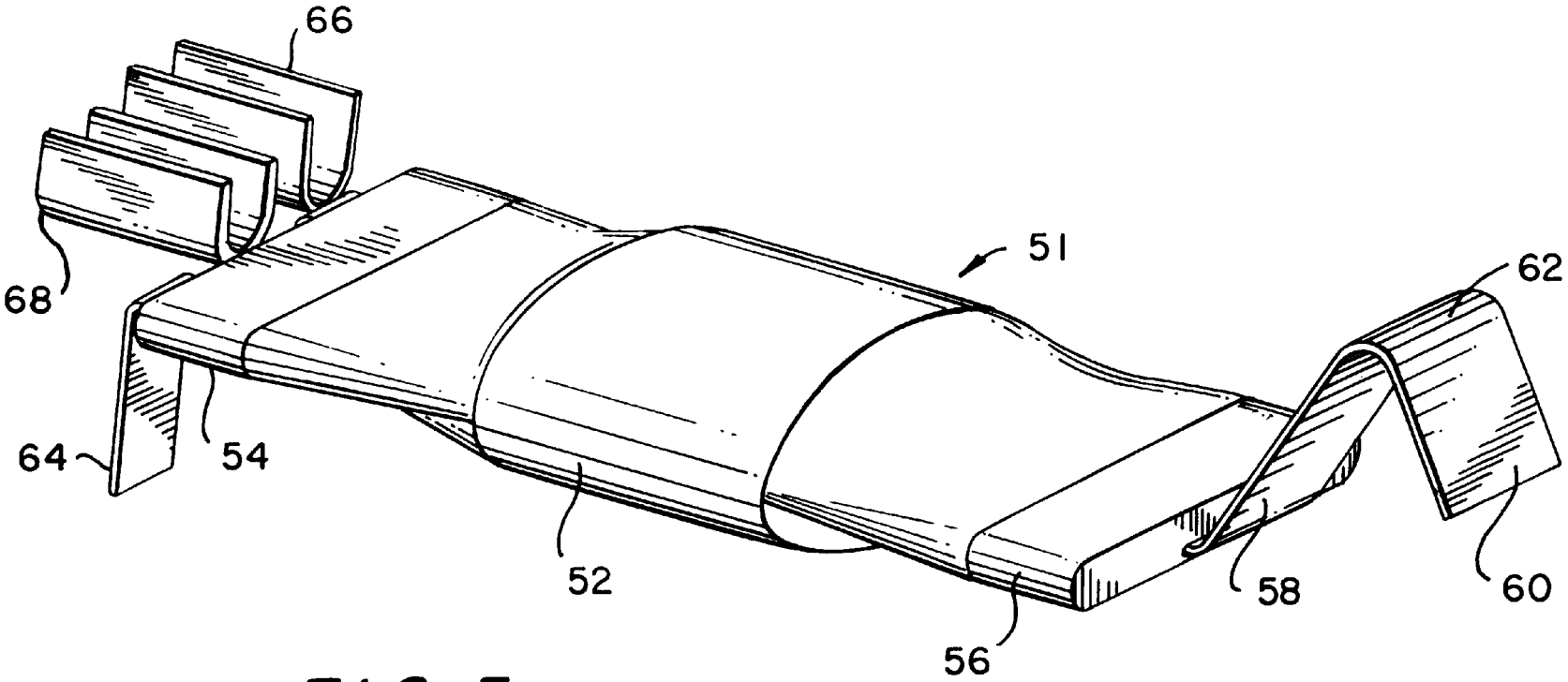
FIG. 3 is a perspective of a waterproof switch according to another embodiment of the present invention.

The sealed switch housing could also be made from a single sheet or tube of material, and FIG. 3 shows a second embodiment 50 of the waterproof switch in which the body is formed of a tube 52 that is slid over the contacts, which would be substantially the same as those shown in FIG. 2. The tube 52 is coated on the inside at the two ends with the heat activated adhesive. The two ends 54 and 56 are pinched together and sealed by applying heat, with an actuator element 58 extending from end 56.

As in the embodiment of FIG. 2, the free-end 60 of the actuator has a curved or transition portion 62 for receiving mechanical actuation to operate the switch. The electrical terminals are provided at end 54 and one terminal 64 is shown corresponding to terminal 30 in the embodiment of FIG. 2 and the other terminals 66 and 68 are shown to receive a stripped wire end. Specifically, terminal 66 corresponds to terminal 26 in FIG. 2, and terminal 68 corresponds to terminal 28 in FIG. 2.

Figure 4C:
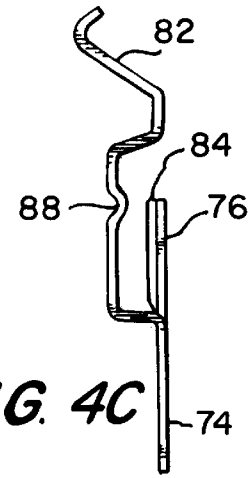
FIGS. 4A–4D represent the contact elements of the switch of FIG. 1 during a manufacturing operation.
Figure 4D:
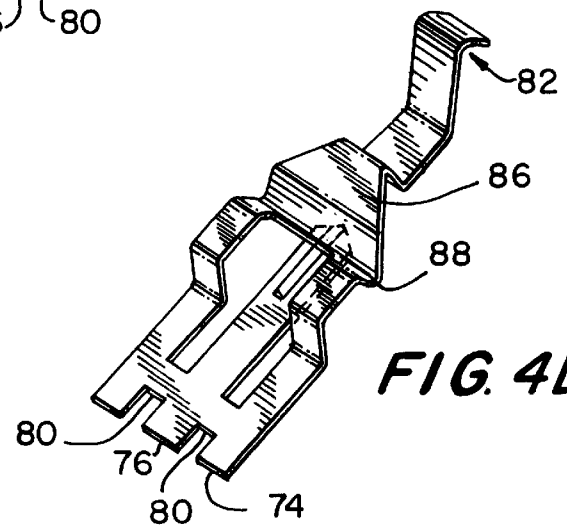

One important feature in the manufacturing of switches is the ability to assemble a switch in a continuous fashion by arranging the switch contacts as part of a continuous strip of metal. FIG. 4A shows a metal strip 70 that is used at the beginning of the manufacturing process for manufacturing switches such as those shown in FIGS. 2 and 3, for example. More particularly, a plurality of Y-shaped or forked elements 72 are provided along the length of a strip, although only two such elements 72 are shown in FIG. 4A the invention contemplates a continuous strip formed of a great number of these switch elements. In between the two arms 74 of each Y-shaped element 72 is arranged an elongated flat strip 76. These flat strips 76 are also part of the metal strip 70. Each of the Y-shaped elements 72 is connected to its adjacent counterpart by an intermediate portion 78 and each elongated strip 76 is connected to the arms 74 of its Y-shaped element 72 by connector portions 80. As will be seen hereinafter, upon completion of the assembly of the switch, the intermediate portions 78 and connector portions 80 are sheared or trimmed away.

Figure 4B:
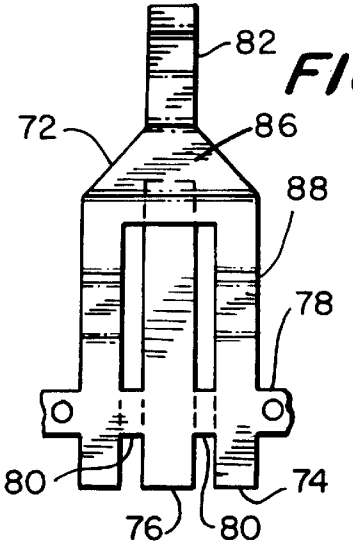
Figure 4A:
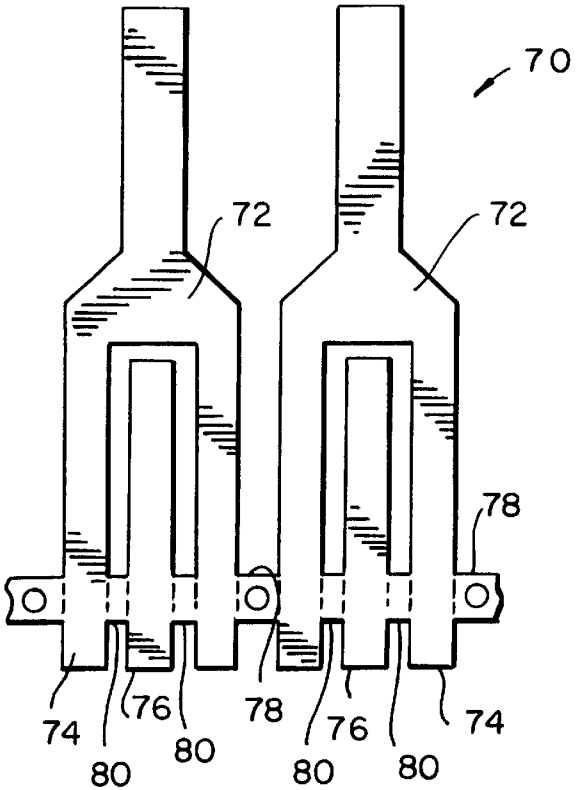

Only one each of the Y-shaped elements 72 and elongated strips 76 is shown in FIG. 4B. The strip 70 shown in FIG. 4A is fed into a crimping machine, not shown, wherein the arms 74 of element 72 are crimped, so that the actuator portion 82 is formed and spring-like elements 84 are formed in the arms 74 of the Y-shaped element 72.

FIG. 4B is a plan view of one set of the switch contact elements, and FIG. 4C is a side elevational view showing the relationship between the arms 74 of the Y-shaped element 72 following the crimping operation relative to the flat strip 76. The strip 76 is also crimped or folded back over to form an electrical contact point 84 for contacting a large contact surface 86 of the Y-shaped element 72. The crimped portions of the arms 74 are shown at 88 in FIGS. 4B and 4C.

Following these mechanical operations and subsequent to the operation involving placing the contacts in the waterproof case, the intermediate portions 78 joining the successive contact pairs on the strip are severed or sheared, and the connector portions 80 joining the center contact 76 with the arms 74 of the Y-shaped elements 72 are severed or sheared.

Thus, it is seen that a manufacturing assembly operation can be done in a continuous fashion by starting off with a strip of contact elements and subsequent to the last operation of sealing the contacts within the waterproof casing, the various elements can be sheared away to create individual waterproof switches.

The intermediate portions 78 can be sheared before the parts of the body are sealed or both the intermediate portions 78 and the connector portions 80 can be removed simultaneously after the switch body parts are sealed together.

It is to be understood, of course, that the above is presented by way of example only and it is not intended to limit the scope or spirit of the present invention, except as set forth in the appended claims.

What is claimed is:

1. A switch assembly comprising:

a body;

a first metal contact element having a connection end protruding from said body for making an electrical connection thereto and having a metal contact point at a contact end; and a second metal contact element arranged adjacent said first metal contact element and having a connection end protruding from said body for making an electrical connection thereto, a middle contact portion, and an actuator end protruding from said body and arranged for deflection, said middle contact portion being in overlying and spaced-apart relationship with said contact end of said first metal contact element, wherein said body is formed of plastic material surrounding said middle contact portion and said contact end of said first metal contact element and is in sealing engagement with said connection end of first metal contact element and said connection end and said actuator end of said second metal contact element, and wherein said contact end of said first metal contact element and said contact end and said actuator end of said second metal contact element protrude from said plastic body in a sealed relationship therewith, said switch assembly being actuated by said actuator end being deflected to cause said middle contact portion of said second metal contact element to move into contact with said contact end of said first metal contact element.

2. The switch assembly according to claim 1, wherein said body comprises:

a planar sheet of plastic material a box-like element formed of plastic material and with an open side-and a planar flange surrounding said open side and arranged facing said planar sheet and having said contact end of said first metal contact element and said middle contact portion of said second metal contact element residing therein; and a heat curable adhesive layer formed between said planar sheet and said planar flange for forming a waterproof seal surrounding said contact end of said first metal contact element and said middle contact portion of said second metal contact element, wherein said contact end of said first metal contact element and said contact end and said actuator end of said second metal contact element sealingly protrude through said heat curable adhesive layer.

3. The suitable assembly according to claim 2, wherein said connection end of said first metal contact element and said connection end of said second contact element are arranged to sealingly protrude through the heat curable adhesive layer at a first side edge of said body and said actuator end is arranged to sealingly protrude through the heat curable adhesive layer at a second side edge of said body opposite said first side edge.

4. The assembly according to claim 1, wherein said actuator end is formed as a strip having a straight portion extending from said body and a free end bent to form an angle with said straight portion.

* * * * *